US008747104B2

(12) United States Patent
Lucas-Puig-Gros

(10) Patent No.: US 8,747,104 B2
(45) Date of Patent: Jun. 10, 2014

(54) LIQUATED GAS LIGHTER WITH NON-ADJUSTABLE FLAME HEIGHT

(75) Inventor: Joan Lucas-Puig-Gros, Terrasa (ES)

(73) Assignee: Flamagas S.A., Barcelona (ES)

( * ) Notice: Subject to any disclaimer, the term of this patent is extended or adjusted under 35 U.S.C. 154(b) by 732 days.

(21) Appl. No.: 12/299,557

(22) PCT Filed: Apr. 30, 2007

(86) PCT No.: PCT/ES2007/000261
§ 371 (c)(1),
(2), (4) Date: Nov. 4, 2008

(87) PCT Pub. No.: WO2007/128853
PCT Pub. Date: Nov. 15, 2007

(65) Prior Publication Data

US 2009/0239183 A1 Sep. 24, 2009

(30) Foreign Application Priority Data

May 5, 2006 (ES) ..... 200601145

(51) Int. Cl.
*F23Q 2/16* (2006.01)

(52) U.S. Cl.
USPC ..... 431/142; 431/146; 431/344; 431/350; 137/544; 137/549

(58) Field of Classification Search
USPC ..... 431/142, 146, 344, 350, 131, 150; 137/544, 549, 550; 222/3
See application file for complete search history.

(56) References Cited

U.S. PATENT DOCUMENTS

| | | | | |
|---|---|---|---|---|
| 4,224,020 | A | 9/1980 | Neyret | |
| 4,243,377 | A | 1/1981 | Schmid | |
| 4,478,570 | A | 10/1984 | Johansson | |
| 4,496,309 | A | 1/1985 | Schächter | |
| 4,669,975 | A * | 6/1987 | Martinez | 431/344 |
| 4,680,007 | A * | 7/1987 | Schachter | 431/344 |
| 4,889,482 | A * | 12/1989 | Schachter | 431/344 |
| 5,192,205 | A * | 3/1993 | Iwahori | 431/344 |
| 5,277,577 | A | 1/1994 | Schachter et al. | |
| 2004/0072114 | A1 * | 4/2004 | Doucet et al. | 431/344 |
| 2004/0152030 | A1 | 8/2004 | Doucet et al. | |

FOREIGN PATENT DOCUMENTS

| | | |
|---|---|---|
| EP | 0 047 708 A2 | 3/1982 |
| ES | 282449 U | 1/1986 |
| ES | 2 000 690 A6 | 3/1988 |
| GB | 1185057 | 3/1970 |

OTHER PUBLICATIONS

The International Search Report for International Appl. No. PCT/ES2007/000261, completed Sep. 13, 2007.

* cited by examiner

*Primary Examiner* — Avinash Savani
(74) *Attorney, Agent, or Firm* — Alston & Bird LLP

(57) ABSTRACT

Liquated gas lighter with non-adjustable flame height, comprising a gas reservoir, a burner and a gas flow limiting device consisting of a microporous membrane gripped between a first seating body and a second seating body. First seating body has a through hole that comes out on one side directly into microporous membrane and on the other side into reservoir. Second seating body has a seating surface in contact with membrane, a groove formed in seating surface, an outlet duct and a linking passage between groove and outlet duct. Through hole is facing, at least partially and through microporous membrane, groove.

14 Claims, 7 Drawing Sheets

LIQUATED GAS LIGHTER WITH NON-ADJUSTABLE FLAME HEIGHT

BACKGROUND OF THE INVENTION

1. Field of the Invention

The invention relates to a liquated gas lighter with non-adjustable flame height, of the type comprising a liquated gas reservoir, a burner provided with a chimney through which a gas flow from said reservoir is sent outside and a gas flow rate limiting device consisting of a microporous membrane gripped between a first seating body and a second seating body, with said first and second seating bodies delimiting a passage area in said membrane.

2. Description of Related Art

With the lighters in the field of the invention, the flame height control is set at a pre-established value by means of a microporous membrane that the gas passes through on its way between the reservoir and the burner. This microporous membrane is gripped between two seating bodies that between them define a passage area in which the membrane faces, on its upstream face, the liquated gas coming from the reservoir and, on its downstream face, a supply duct for supplying gas to the burner. The liquated gas from the reservoir reaches the membrane on said upstream face, diffuses into the microporous material of the membrane and leaves it via said downstream face towards said supply duct. The flow rate of the gas released through the membrane largely depends on the membrane surface that is facing the supply duct for supplying gas to the burner. The surface and the physical characteristics of the membrane thus determine a substantially constant gas outlet flow rate (under normal operating conditions).

This type of lighter must be designed to prevent any possible breakage of the microporous membrane, which, as it is very thin, is not very resistant to mechanical stress. Moreover, in order to ensure a substantially constant gas flow rate, the lighter design must guarantee that there are no variations in the position of the membrane over time. Also, the design must prevent the membrane from experiencing any vibrations. In the lighters of the type under consideration, these difficulties are overcome by gripping the membrane between two seating surfaces, which allows to firmly hold the membrane and exposes only a reduced part of its surface to the direct action of the liquated gas. Even so, the membrane is exposed to breakage by liquated gas from the reservoir arriving suddenly in liquid phase (hereinafter "dynamic surge"). This situation occurs particularly when the lighter is knocked violently. In the known lighters of the type under consideration, this problem is overcome by providing a labyrinth path for the liquated gas route between the reservoir and the membrane. Another known solution consists in arranging some kind of reinforcement over the membrane, such as for example a mesh applied to it.

Also a dangerous increase in the flame height could occur once the lighter has adopted a horizontal position, in which the membrane is permanently wetted by gas in liquid state which ends up accumulating downstream of the membrane. In these circumstances, the gas outlet flow rate can be considerably greater during a short transitory period, until the gas in liquid state, near the membrane, has evaporated. It is important that the design of this type of lighters maintains this transitory situation within acceptable limits.

The known lighters of the type under consideration resolve these problems with greater or lesser success, but they are still not completely satisfactory. In fact, the known lighters require an expensive manufacturing process or, when manufacturing is more economical, the lighters are not as robust.

Spanish patent ES2000690 in the name of the actual applicant discloses a lighter with non-adjustable flame height wherein the first seating body, located upstream from the membrane, has an elongated cylindrical shape and has a longitudinal, peripheral groove for the passage of the liquated gas from the reservoir. This groove comes out into an annular pool formed in said first seating body. The second seating body, downstream from the membrane, has a short straight gas outlet hole that faces said annular pool and leads directly to the stopper system of the burner. Said Spanish patent also discloses a second embodiment of the lighter wherein the passage groove for the liquated gas is in a centred position and comes out into the pool not directly but rather passing via a transverse channel. These designs manage to minimize the dynamic surge on the membrane, thanks to the high pressure drop caused by the length of the liquated gas passage groove. However, these designs suffer from the drawback that they are complicated and expensive to manufacture. Said patent also discloses a third embodiment that is similar to the second, but wherein the first seating body is much shorter. This design is less robust in terms of the membrane's breaking strength with respect to a dynamic surge and, at any event, it is expensive to manufacture because the second seating body has a complicated geometry. In short, the lighter designs disclosed in document ES2000690 can be improved in terms of manufacturing costs and the robustness of the membrane with respect to a dynamic surge. Moreover the outlet flow rate limitation, when the liquated gas that reaches the membrane is in a liquid phase, can be improved.

Documents EP0047708 and U.S. Pat. No. 4,224,020 disclose liquated gas lighters with a non-adjustable flame height that are shaped generally like the lighters under consideration, but with the important difference that between the membrane and the second seating body a porous layer is arranged as a reinforcement that prevents the membrane from breaking as a result of a dynamic pressure surge. This porous reinforcement layer allows the membrane to be exposed more directly to the gas ducts defined in the seating bodies, which can then be straight, directly facing each other and with a larger diameter. This solution has the advantage that the seating bodies have a simple geometry. However, it is important to bear in mind that this simple geometry is not viable without the said porous reinforcement layer, which, in fact, considerably increases the manufacturing cost of the lighter.

SUMMARY OF THE INVENTION

The aim of the invention is to overcome the drawbacks of the state of the art. This purpose is achieved by means of a liquated gas lighter of the type indicated at the beginning, characterized in that:

- said first seating body comprises at least one through hole that comes out, on one side directly into said microporous membrane, and on the other side into said liquated gas reservoir, with said through hole defining in said microporous membrane a first area coinciding with said through hole;
- said second seating body comprises a seating surface in contact with said microporous membrane, a groove formed in said seating surface, an outlet duct towards said chimney and at least one linking passage connecting said groove to said outlet duct, with said groove defining in said microporous membrane a second area coinciding with said groove;
- so that, when said first and second seating bodies are assembled one against the other gripping said microporous membrane between them, each of said through holes in the first seating body is facing, at least partially and through said microporous membrane, said groove in the second seating body, so that said second area defines an intersection with each of said first areas, with said passage area being defined by the sum of said intersections;

and with one part of said microporous membrane, corresponding to a part of said first area, resting on said seating surface.

The design according to the invention provides an extremely simple and robust solution. The geometry of the first seating body is much simpler than in the lighters disclosed in document ES2000690, because the pool formed in the face of the seating body facing the membrane has been removed. The liquated gas from the reservoir therefore reaches the membrane directly via the through holes. The membrane is prevented from breaking as a result of a dynamic pressure surge because the passage area through the membrane is defined by the part of said through holes that is directly facing the groove of the second seating body, which makes it possible to optimally adjust the exposed surface of the membrane. Moreover, the removal of the gas in the second seating body is performed by the gas flowing from said groove towards the chimney via the linking passage. All this allows to design a second seating body with a simple geometry and that is economical to manufacture.

Also, the lighter according to the invention guarantees, in a fully satisfactory manner, the limitation of the outlet flow rate if the liquated gas which reaches the membrane is in liquid phase, and this if for two reasons. First of all, the volume that the gas in liquid state can occupy near the membrane is reduced, particularly thanks to the fact that the pool upstream the membrane has been removed. Secondly, because the liquid arriving via said through hole wets said first area of the membrane, diffuses in the microporous material forming said membrane and evaporates in said second area. In this case, the flow rate of the gas leaving the membrane depends substantially on this second area, and therefore it is substantially constant. The membrane passage area, defined by the intersection of said first and second areas, can be a small portion of the these, which considerably reduces the possibility of the gas in liquid phase crossing the membrane directly through said passage area and arriving in a liquid state downstream of the membrane.

Advantageously, said groove formed in the seating surface of the second body is annular, centred on an axis, and said at least one through hole consists of a circular hole formed in the first seating body. This simple characteristic simplifies the assembly of both seating bodies, because the through hole always coincides with the annular groove, irrespective of the relative angular position of said seating bodies.

Preferably, the passage area is greater or equal to 0.0164 square millimeters and; with said annular groove being delimited, at the level of said seating surface, by a lower radius and an upper radius, and the size and position of each of said through holes being defined by the diameter and the eccentricity thereof with respect to said axis; for each of said through holes the result obtained from adding to said eccentricity half of said diameter and subtracting therefrom said lower radius, is less than or equal to 0.2475 millimeters, with all these magnitudes being expressed in millimeters. This latter condition is equivalent to saying that said through hole projects into said annular groove a maximum distance of 0.2475 mm. The applicant has verified on an experimental basis that the value of 0.0164 square millimeters, referring to the passage area of the membrane, is the minimum recommended value for obtaining an effective gas flow rate. The applicant has also been able to verify that when a through hole projects into the groove a distance greater than 0.2475 mm, it is not possible to guarantee with a sufficient degree of confidence that the membrane will not break as a result of a dynamic surge.

Preferably, the first seating body is a cylindrical circular plate circular arranged concentrically with said circular groove, said through hole being unique and arranged eccentrically with respect to said axis. This geometry is particularly simple and economical to manufacture. In this case, the passage area is defined by the single intersection between the circular groove of the second seating body and said through hole.

Preferably, the second seating body is a solid of revolution comprising a cylindrical housing that has a circular shaped bottom wall that forms the seating surface against which the microporous membrane is arranged, with the first seating body being arranged in said cylindrical housing pressing on the microporous membrane, so that the first seating body, formed by a cylindrical, circular plate, fits tightly in said cylindrical housing. Also, advantageously, in this second seating body the end of the cylindrical housing opposite the seating surface is surrounded by an annular shoulder that folds onto the first seating body in order to keep it pressing on said microporous membrane. This design makes it possible to press the membrane optimally between the two seating bodies and mutually join both seating bodies.

Advantageously, the outlet duct of the second seating body is made up of a single through hole centred in said axis, with the linking passage being made up of at least one slot formed in the seating surface. Preferably, there are two of these slots, and they are mutually aligned in a diametrical direction perpendicular to said axis and, more preferably, they have a triangular section. This design considerably facilitates the manufacturing of the part and therefore leads to a lower cost. Also, the applicant has been able to verify that this design provides efficient gas removal downstream of the membrane, thereby reducing the risk of an excessive flame height when the liquated gas is in liquid phase near the membrane.

According to a preferable embodiment of the invention, said annular groove delimitates an inner area and an outer area of the seating surface of said second seating body, with the inner area being lowered with respect to the outer area a distance that is less than the thickness of the microporous membrane before being mounted in a pressed state between both seating bodies. This solution means that the membrane presses less in the inner area than in the outer area, thereby avoiding excessive pressure on the membrane that could lead to said membrane breaking prematurely.

Preferably, the lighter according to the invention is of the type comprising an elongated bushing placed between the liquated gas reservoir and the outside, with said bushing defining an internal chamber where the burner provided with a chimney slides, and it is characterized in that said second seating body closes said internal chamber at its end opposite said reservoir, leaving said outlet duct as the only opening in the direction of said reservoir. Thanks to this arrangement, it is possible to obtain a simple and effective design of the stopper device that must be present in all the lighters of the type under consideration, and which enables the gas passage to the outside to be opened and closed. In fact, in the lighter according to the invention the stopper device can consist advantageously of a stopper element provided on the lower end of the burner, so that when the burner moves in the axial direction in the internal bushing chamber, the stopper element stops or opens said single opening of the chamber.

In an improvement of the invention, said bushing and said second seating body are formed as a single integral part made from a heat conductive material such as for example, and preferably, an aluminum alloy. This integral arrangement, which can be obtained advantageously through deep drawing, optimizes manufacturing costs. Moreover, the high thermal conductivity of the material of this integral part provides sufficient heat transfer from the bushing end, which is in a hot area near the flame, to the second seating body. By virtue of this arrangement, the gas in liquid phase that may be near the membrane, when the lighter has been in a horizontal position, evaporates quickly, thereby reducing the transitory high flame height situation that occurs in these cases.

Advantageously, said seating surface on the second seating body has a peripheral throat which prevents it from deforming when said groove is formed by deep drawing. This way a perfectly flat seating surface is obtained, which guarantees continuous contact with the membrane.

BRIEF DESCRIPTION OF THE SEVERAL VIEWS OF THE DRAWINGS

Other advantages and characteristics of the invention are appreciated from the following description, wherein, in a non-limiting manner, some preferable embodiments of the invention are described, with reference to the accompanying drawings, in which.

DETAILED DESCRIPTION OF THE INVENTION

Figure 1:
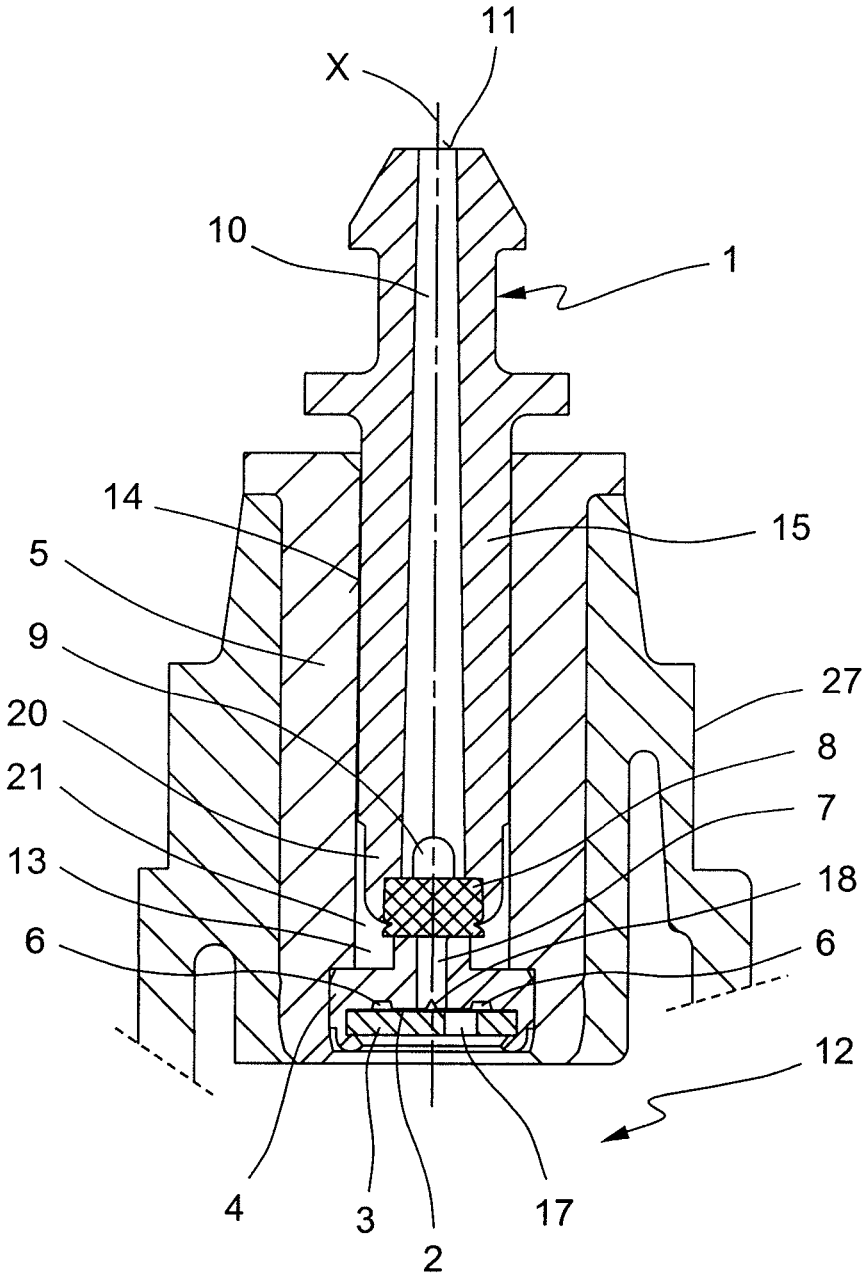
FIG. 1 is a partial sectional view of a first embodiment of a lighter according to the invention, showing in particular the part of the lighter comprising the valve unit.

FIGS. 1 through 7 relate to a first embodiment of the lighter according to the invention. FIG. 1 is a partial sectional view of the part of the lighter that comprises the valve unit, wherein the details that are not necessary for understanding this invention have been omitted. The lighter, which is of the non-adjustable flame height type, is essentially made up of a lighter body 27 made from plastic material that delimitates within it a liquated gas reservoir 12 (not shown), an elongated bushing 5, also of plastic material, arranged between reservoir 12 and the outside and, assembled on said bushing 5, a burner 1 that has a chimney 10 through which a gas flow from reservoir 12 is sent to the outside, a stopper element 8 and a gas flow rate limiting device made up of a microporous membrane 2 gripped between a first seating body 3 and a second seating body 4 that mutually define a passage area Ap in said membrane. Bushing 5 defines an internal cylindrical chamber 13 wherein burner 1 fits slidably. Chamber 13 is closed at its lower end by second seating body 4, which has an outlet duct 7 that defines the only communication that chamber 13 has with the gas from reservoir 12. The lower section of burner 1 has a smaller diameter than that of chamber 13 and on its lower end it has a stopper element 8 made from an elastomeric material and a side port 9 that associates chamber 13 with chimney 10 of the burner. Traditionally the lighter comprises a push button fitted with a spring (not shown) which in its rest position keeps the bushing so that stopper element 8 closes outlet duct 7. In this position, the gas outlet to the outside is closed. When the user activates the push button, bushing 5 moves upwards, so that stopper element 8 leaves outlet duct 7 free. In this position, the gas outlet to the outside is open and a gas flow rate is released which, under nominal conditions, is constant and is imposed substantially by passage area Ap defined in microporous membrane 2 between seating bodies 3 and 4.

FIGS. 2 to 7 define the particular geometry of seating bodies 3 and 4, which both have a circular geometry, centred in a common axis X. The parts forming seating bodies 3 and 4 are metallic and are obtained through undercutting.

Figure 5:
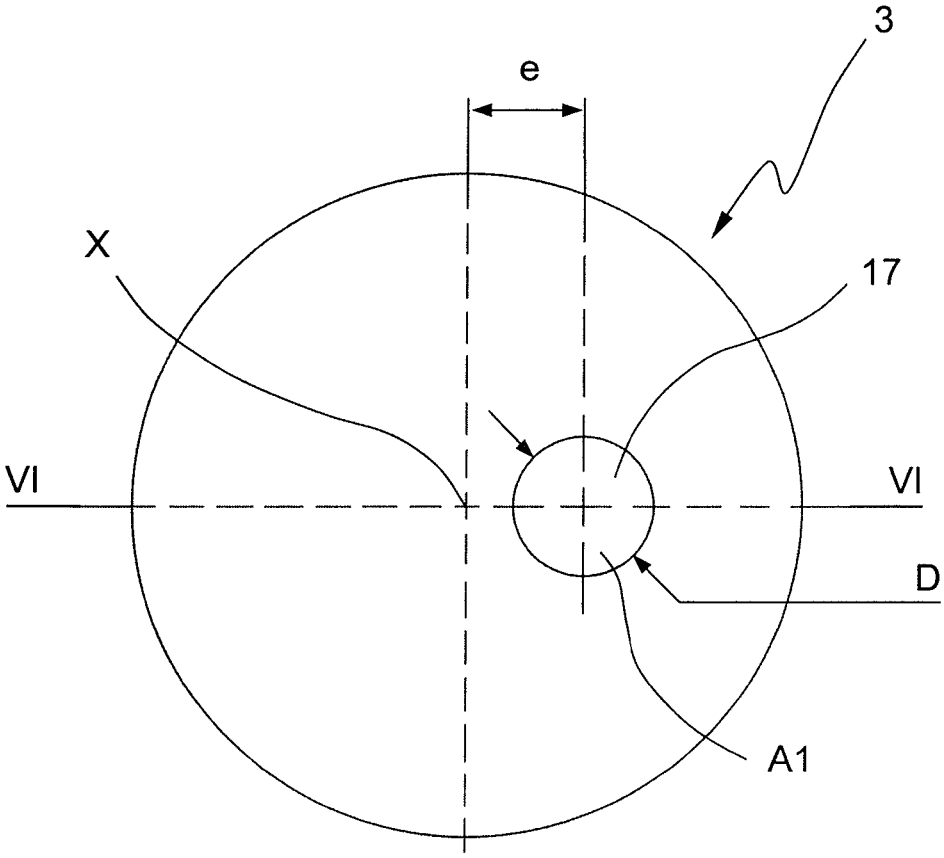
FIG. 5 and FIG. 6 are, respectively, a lower plane view and a side sectional view along the line VI-IVI in FIG. 3, of the second seating body in FIG. 2, in a non-assembled state.
Figure 6:
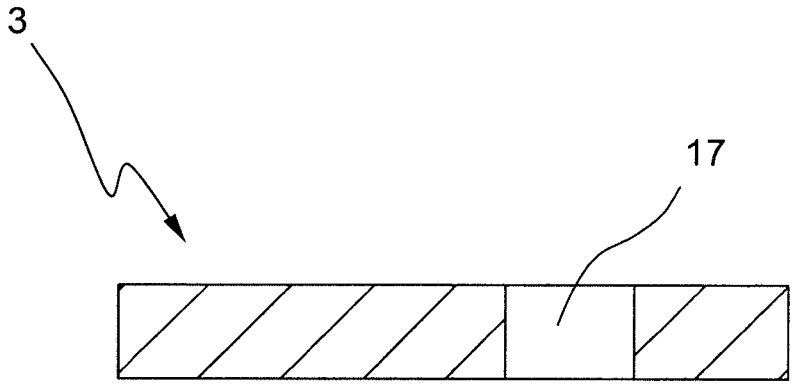

First seating body 3, which in FIGS. 5 and 6 is shown in a non-assembled state, is a cylindrical plate perforated with a single circular through hole 17 arranged eccentrically with respect to axis X and which, in the assembled position shown in FIG. 1, comes out one side directly into microporous membrane 2 and on the other side into liquated gas reservoir 12. Said through hole 17 defines in microporous membrane 2 a first area A1, which is the area of said through hole 17 seen by membrane 2.

Figure 3:
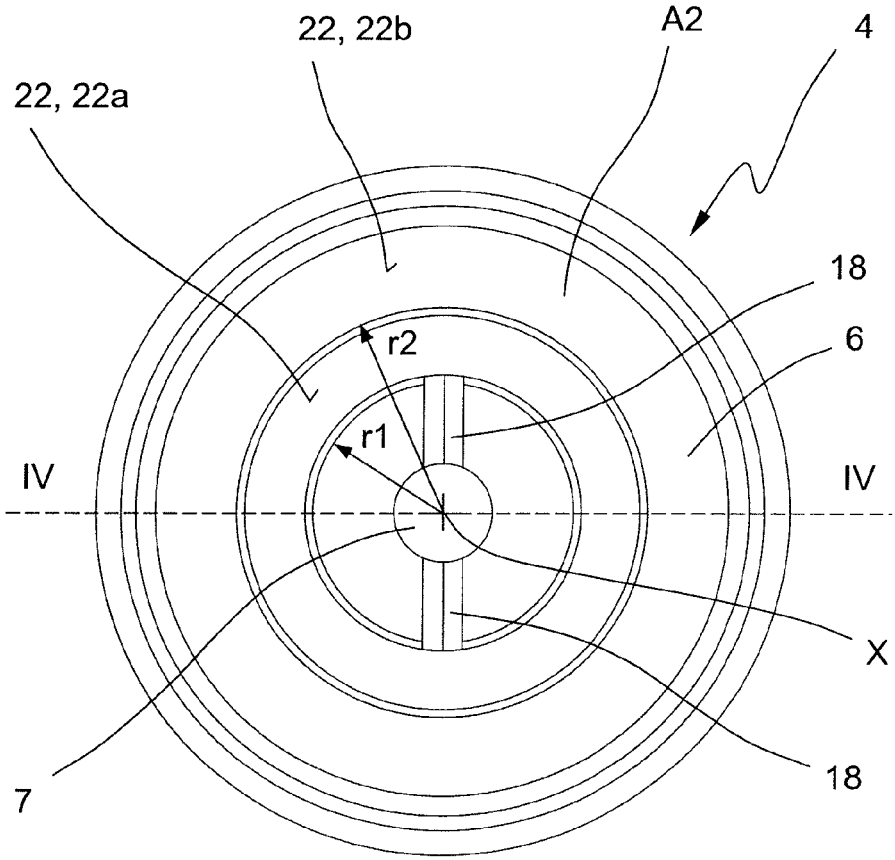
FIG. 3 and FIG. 4 are, respectively, a lower plane view and a side sectional view along the line IV-IV in FIG. 3, of the first seating body in FIG. 2, in a non-assembled state.
Figure 4:
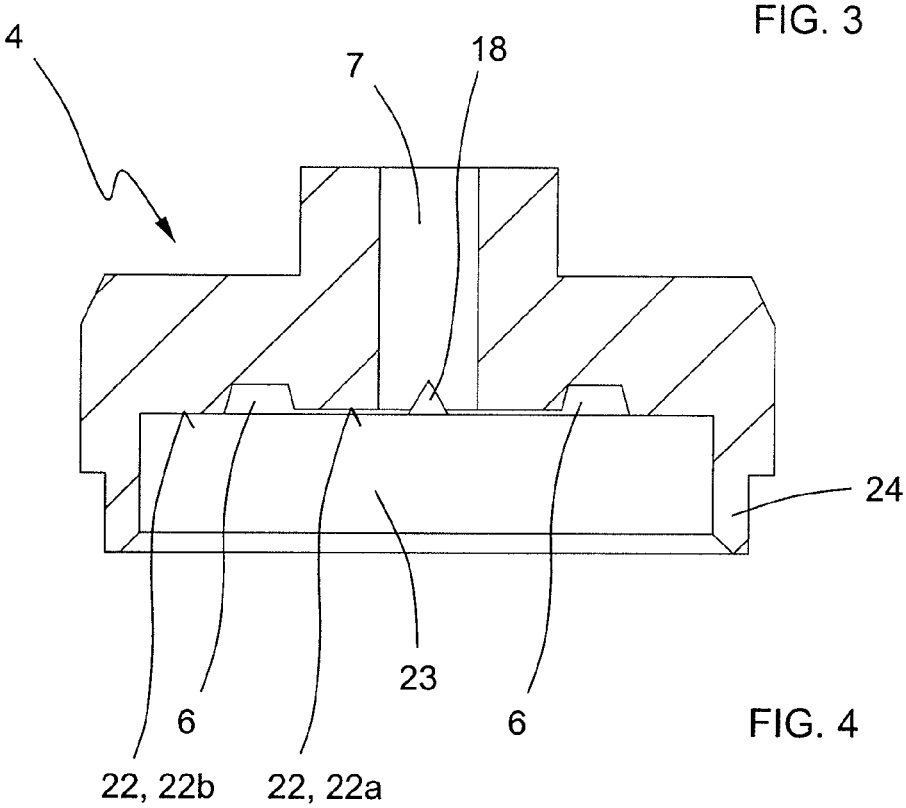
Figure 7:
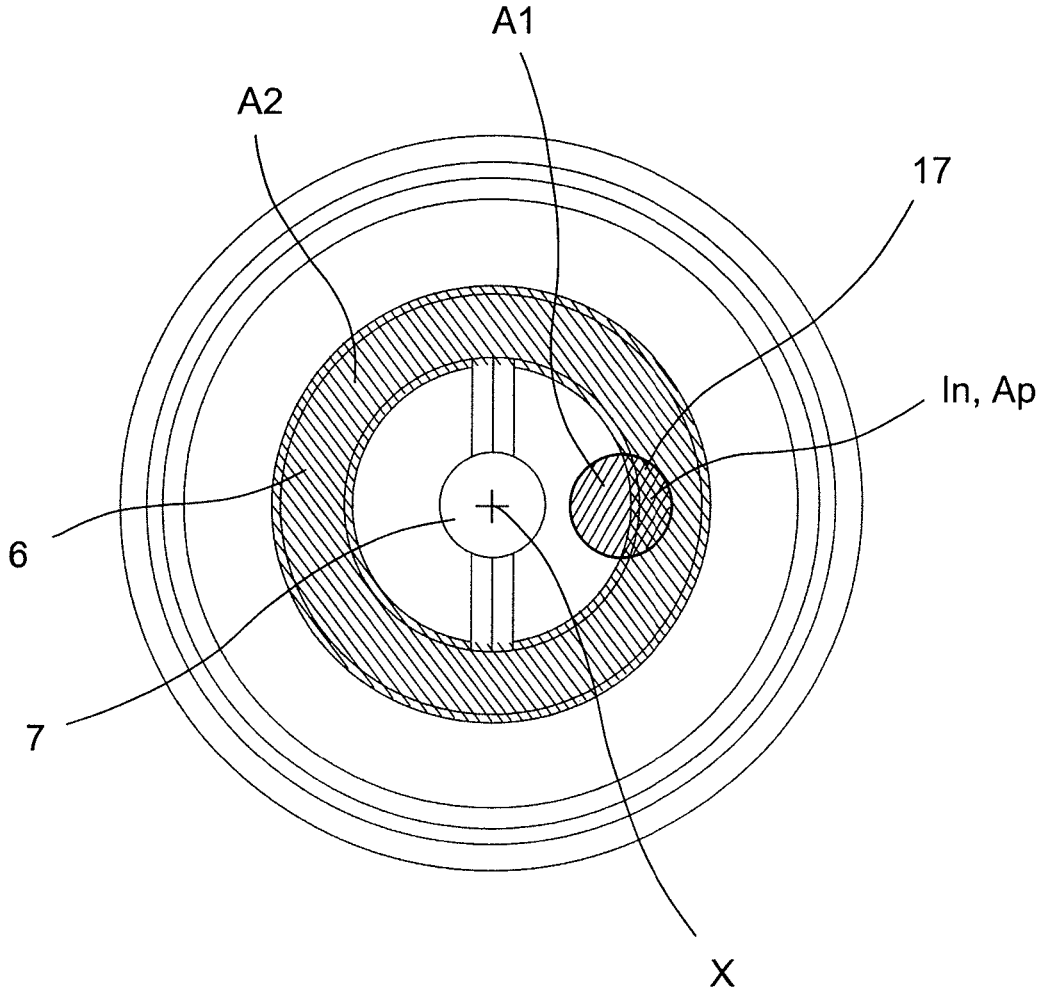
FIG. 7 is a diagrammatic plane view of the passage areas defined between the seating bodies in FIG. 2.

Second seating body 4, which in FIGS. 3 and 4 is shown in a non-assembled state, is a part made up of a solid of revolution comprising a cylindrical housing 23 that has a circular shaped bottom wall that forms seating surface 22 against which microporous membrane 2 is arranged. First seating body 3 fits tightly in said cylindrical housing 23 of second seating body 4, gripping microporous membrane 2. Said seating surface 22 in contact with microporous membrane 2 has a groove 6 centred in axis X and partially facing, through said membrane 2, through hole 17 of first seating body 3. Annular groove 6 defines an inner area 22*a* and an outer area 22*b* of seating surface 22. Inner area 22*a* is lowered with respect to outer area 22*b* a distance less than the thickness of said microporous membrane 2 (considered before assembly), so that membrane 2 is pressed more in outer area 22*b* than in inner area 22*a*. Moreover, groove 6 defines in microporous membrane 2 a second area A2, which is the area of said groove 6 seen by microporous membrane 2. The intersection In between said first area A1 and said second area A2 defines the passage area through microporous membrane 2. As can be seen in FIG. 7, first area A1 defined by through hole 17 projects from second passage area A2 defined by groove 6, whereby in the part of area A1 that is outside the intersection with area A2 the surface of microporous membrane 2 rests on said seating surface 22. The second seating body also has an outlet duct 7 that comes out into chamber 13 towards chimney 10 and which communicates with groove 6 through a linking passage 18. Outlet duct 7 is made up of a single through hole centred in axis X and linking passage 18 is made up of two slots with a triangular section formed in seating surface 22 and mutually aligned in a diametrical direction perpendicular to axis X.

In this embodiment example, annular groove 6 is defined by a lower radius r1 measuring 0.675 mm and an upper radius r2 measuring 1.0056 mm, both centred in axis X. Through hole 17 has a diameter D measuring 0.6 mm and its centre lies at a distance e of 0.5 mm with respect to axis X. With these geometrical values, passage area Ap in microporous membrane 2, defined by the intersection of areas A1 and A2, has a value of 0.11967 $mm^2$ and the maximum cantilever distance of area A1 over area A2, defined by the expression (e+½D−r1), is 0.125 mm.

Figure 2:
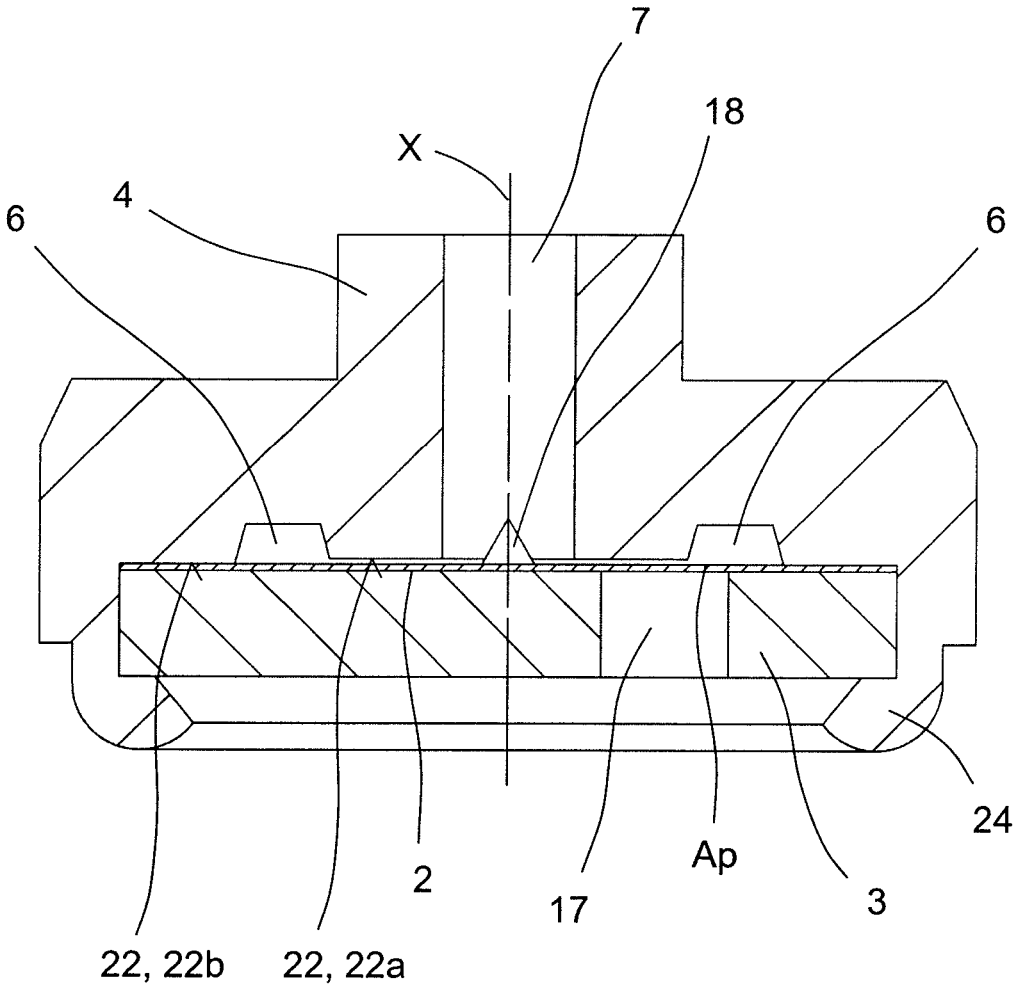
FIG. 2, is an enlarged sectional view of the assembly of the two seating bodies that grip the microporous membrane between them in the lighter according to FIG. 1.

FIG. 2 shows that the end of cylindrical housing 23 opposite seating surface 22 is surrounded by an annular shoulder 24 that folds onto said first seating body 3 to keep it gripped against said microporous membrane 2 (FIG. 4 shows shoulder 24 in its original state before folding).

Figure 8:
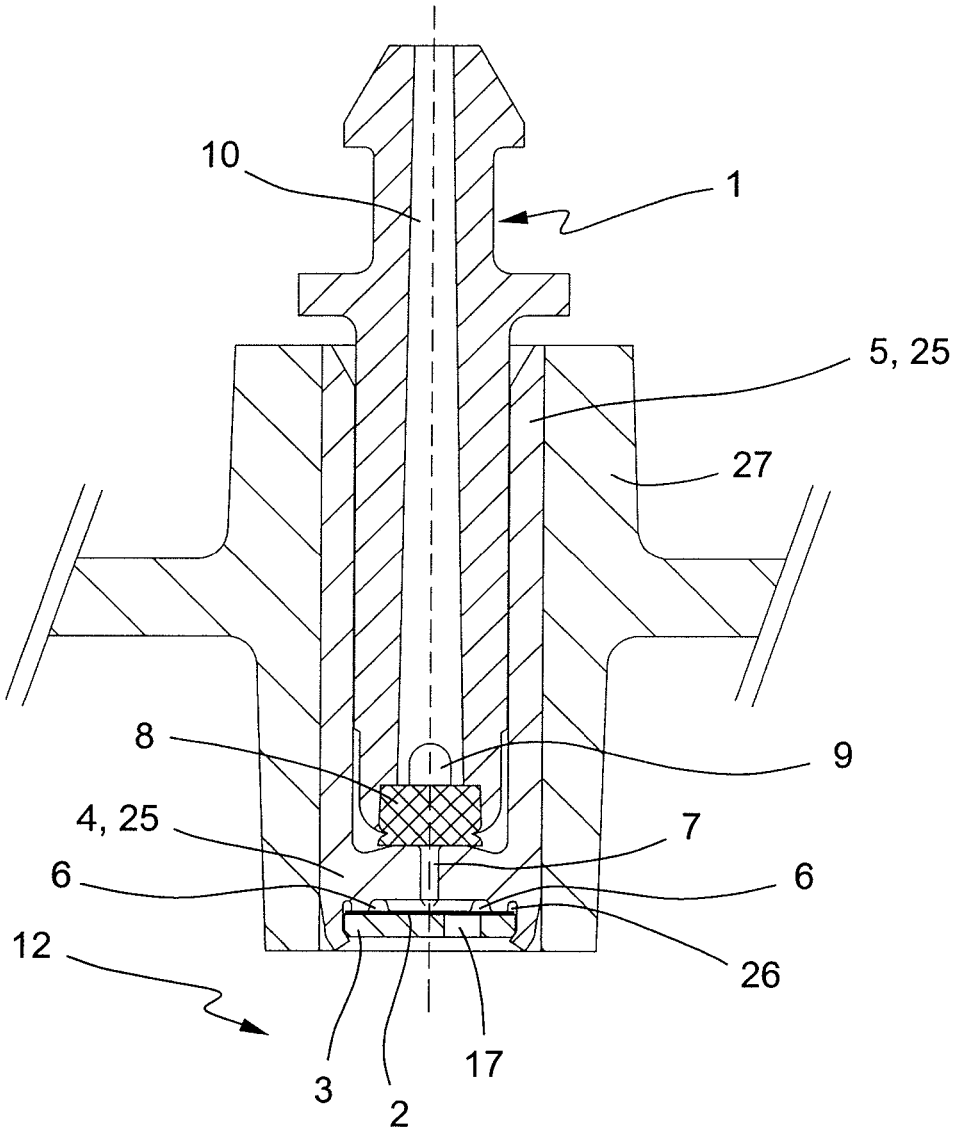
FIG. 8 is a partial sectional view of a second embodiment of a lighter according to the invention, showing in particular the part of the lighter comprising the valve unit.

FIG. 8 shows a second embodiment of the lighter according to the invention that is similar to the first, except that bushing 5 and second seating body 4 are formed as a single integral part 25, made from an aluminum alloy through deep drawing. This arrangement provides good heat transmission by conduction through integral part 25, from the top of the bushing to the second seating body, which causes the gas in liquid phase that may have accumulated near membrane 2 to evaporate quickly. This way the transitory high flame height regimes that occur in these cases are significantly limited.

As can be seen in FIG. 8, seating surface 22 on second seating body 4 has a peripheral throat 26 that facilitates forming groove 6 through deep drawing without deforming the flan area of said seating surface 22 on which membrane 2 rests.

Figure 9:
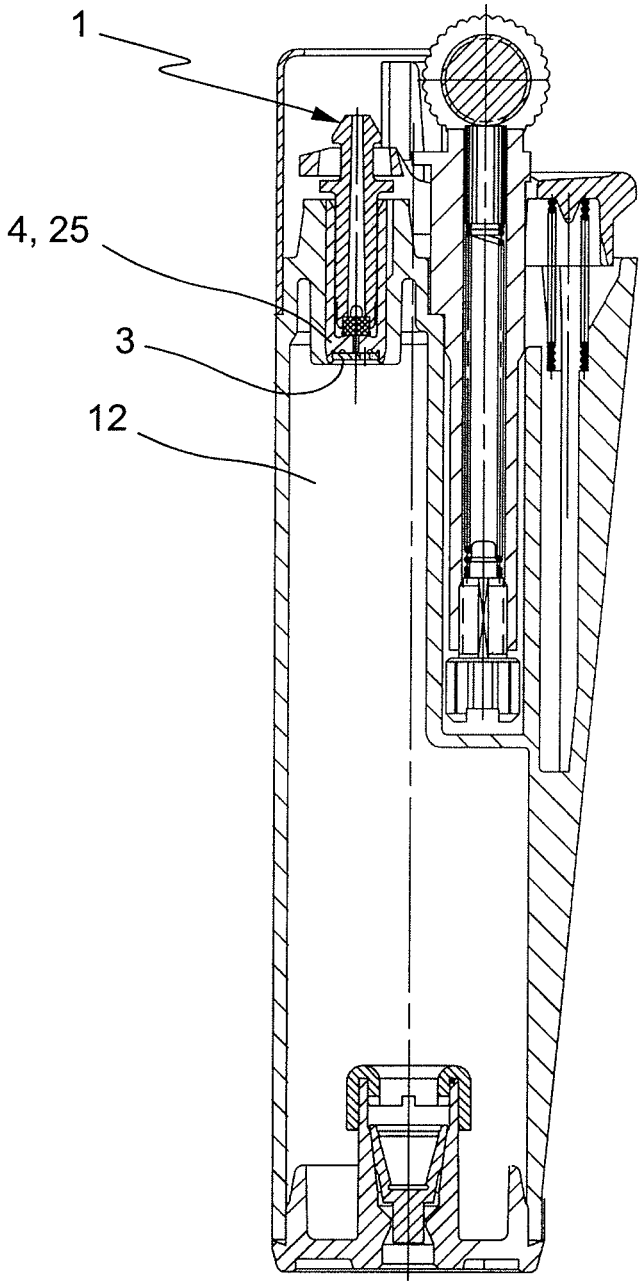
FIG. 9 is a complete view, in section, of a lighter according to the invention that includes the value unit shown in FIG. 8.

Finally, FIG. 9 illustrates a lighter according to the invention that is fitted with the valve unit shown in FIG. 8. Naturally, the same lighter can be fitted with a valve unit as shown in FIGS. 1 through 7.

The person skilled in the art will understand that the embodiments of the invention described above are merely non-limiting examples which can be subject to several variations, without thereby departing from the context of this invention. In particular, through hole 17, which defines first area A1, does not have to be a single hole: a plurality of through holes 17 can be provided on first seating body 3. Nevertheless, increasing the number of holes 17 increases the cost of manufacturing the part. Also, a dimensioning can be envisaged whereby the position and size of through hole 17 are such that said hole 17 is slightly superimposed on outlet duct 7, so that a fraction of the gas flow crosses membrane 2 through said superimposition. With respect to groove 6 of second seating body 4, it can be any shape other than a concentric circle. However, the concentric circular shape is the most advantageous, because it allows first seating body 3 to be assembled in second seating body 4 without the need to control the position of through hole 17 with respect to groove 6.

The invention claimed is:

1. A liquated gas lighter with non-adjustable flame height, of the type comprising a liquated gas reservoir, a burner provided with a chimney through which a gas flow from said liquated gas reservoir is sent outside and a gas flow rate limiting device consisting of a microporous membrane gripped between a first seating body and a second seating body, with said first and second seating bodies delimitating a passage area in said membrane; wherein:

said first seating body comprises at least one through hole that comes out, on one side directly into said microporous membrane, reaching and directly intersecting said microporous membrane, and on the other side into said liquated gas reservoir, with the intersection of said through hole and said microporous membrane defining in said microporous membrane a first area coinciding with said through hole;

said second seating body comprises a seating surface in contact with said microporous membrane, a groove formed in said seating surface, an outlet duct towards said chimney and at least one linking passage that connects said groove to said outlet duct, with said groove defining in said microporous membrane a second area coinciding with said groove;

said first and second seating bodies are shaped so that when they are assembled one against the other gripping said microporous membrane between them, said through hole on said first seating body is facing, partially and through said microporous membrane, said groove of said second seating body, so that a part of said first area faces said groove and the other part of said first area does not face said groove, and so that said second area defines with said first area an intersection, with said passage area being thus defined by the sum of said intersections;

and so that one side of said microporous membrane rests on said seating surface of the second seating body in the part of said first surface which does not face said groove, and simultaneously the opposite side of said microporous membrane rests on said first seating body along the perimeter of said first area.

2. The lighter according to claim 1, wherein said groove formed in said seating surface of second body is annular, centred on an axis, and said through hole consists of a circular hole formed in said first seating body.

3. The lighter according to claim 2, wherein said passage area is greater or equal to 0.0164 square millimeters and; with said annular groove being defined, at the level of said seating surface, by a lower radius and an upper radius, and the size and position of said through hole being defined by the diameter and the eccentricity thereof with respect to said axis; for said through hole the result obtained from adding to said eccentricity half of said diameter and subtracting therefrom said lower radius is less than or equal to 0.2475 millimeters, with all these magnitudes being expressed in millimeters.

4. The lighter according to claim 3, wherein said first seating body is a cylindrical circular plate arranged concentrically with said circular groove, with said through hole being unique and arranged eccentrically with respect to said axis.

5. The lighter according to claim 4, wherein said second seating body is a solid of revolution comprising a cylindrical housing that has a circular shape bottom wall that forms said seating surface against which said microporous membrane is arranged, with said first seating body being arranged in said cylindrical housing pressing on said microporous membrane.

6. The lighter according to claim 5, wherein in said second seating body the end of said cylindrical housing opposite said seating surface is surrounded by an annular shoulder that folds onto said first seating body to keep it pressed on said microporous membrane.

7. The lighter according to claim 2, wherein said outlet duct of second seating body is made up of a single through hole centred in said axis, with said linking passage being formed by at least one slot formed in said seating surface.

8. The lighter according to claim 7, wherein said linking passage is made up of two slots formed in said seating surface and mutually aligned in a diametrical direction perpendicular to said axis.

9. The lighter according to claim 8, wherein said slots forming said linking passage have a triangular section.

10. The lighter according to claim 2, wherein said annular groove delimitates an inner area and an outer area of said seating surface, with said inner area being lowered with respect to said outer area a distance less than the thickness of said microporous membrane before being assembled in a pressed condition between said seating bodies.

11. The lighter according to claim 1, further comprising an elongated bushing arranged between said liquated gas reservoir and the outside, with said bushing defining an internal chamber where said burner provided with a chimney slides, wherein said second seating body closes said internal chamber at its end opposite said reservoir, leaving said outlet duct as the only opening in the direction of said reservoir.

12. The lighter according to claim 11, wherein said bushing and said second seating body are formed as a single integral part made from a thermal conductive material.

13. The lighter according to claim 12, wherein said integral part is made from an aluminum alloy.

14. The lighter according to claim 12, wherein said seating surface on second seating body has a peripheral throat.

* * * * *

UNITED STATES PATENT AND TRADEMARK OFFICE

CERTIFICATE OF CORRECTION

PATENT NO. : 8,747,104 B2
APPLICATION NO. : 12/299557
DATED : June 10, 2014
INVENTOR(S) : Lucas-Puig-Gros It is certified that error appears in the above-identified patent and that said Letters Patent is hereby corrected as shown below:

Title page,

Item (75) Inventor: "Terrasa (ES)" should read --Terrassa (ES)--.

Signed and Sealed this
Twenty-first Day of October, 2014

Michelle K. Lee

Michelle K. Lee
*Deputy Director of the United States Patent and Trademark Office*